US005986607A

United States Patent [19]

Rudisill

[11] Patent Number: 5,986,607

[45] Date of Patent: Nov. 16, 1999

[54] SWITCHABLE MATCHING CIRCUITS USING THREE DIMENSIONAL CIRCUIT CARRIERS

[75] Inventor: Charles A. Rudisill, Apex, N.C.

[73] Assignee: Ericsson, Inc., Research Triangle Park, N.C.

[21] Appl. No.: 08/935,448

[22] Filed: Sep. 23, 1997

[51] Int. Cl.[6] ..... H01Q 1/24; H01Q 9/00; H01Q 1/50

[52] U.S. Cl. ..... 343/702; 343/749; 343/860

[58] Field of Search ..... 343/702, 850, 343/860, 895, 700 MS; H01Q 1/24

[56] References Cited

U.S. PATENT DOCUMENTS

| | | | |
|---|---|---|---|
| 5,427,532 | 6/1995 | Owen et al. | 439/57 |
| 5,717,408 | 2/1998 | Sullivan et al. | 343/702 |
| 5,874,921 | 2/1999 | Doherty et al. | 343/702 |

FOREIGN PATENT DOCUMENTS

| | | |
|---|---|---|
| 0506042A | 9/1992 | European Pat. Off. . |
| 0694990A | 1/1996 | European Pat. Off. . |
| 2308502A | 6/1997 | United Kingdom . |
| 2308746A | 7/1997 | United Kingdom . |
| WO97/23014A | 6/1995 | WIPO . |

*Primary Examiner*—Don Wong
*Assistant Examiner*—Jennifer H. Malos
*Attorney, Agent, or Firm*—Myers Bigel Sibley & Sajovec, P.A.

[57] ABSTRACT

Radiotelephone antenna assemblies including three-dimensional carrier circuits which integrate separate signal and ground paths on an antenna base assembly and which includes a matching circuit thereon. The present invention configures the antenna assembly passage to define a three dimensional circuit to match the differing impedances generated by retractable top load antennas (retracted and extended impedances) without requiring a separate switching circuit and wiping contacts.

35 Claims, 10 Drawing Sheets

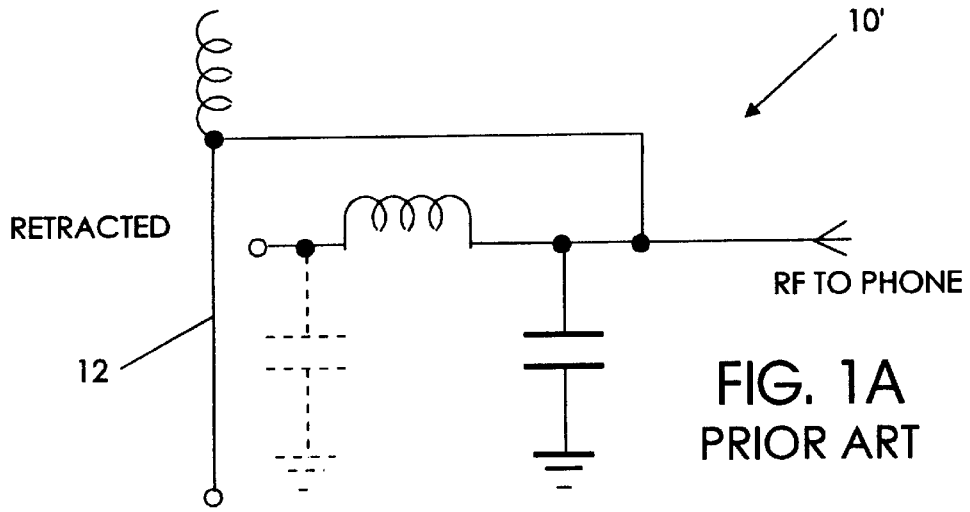
FIG. 1A
PRIOR ART
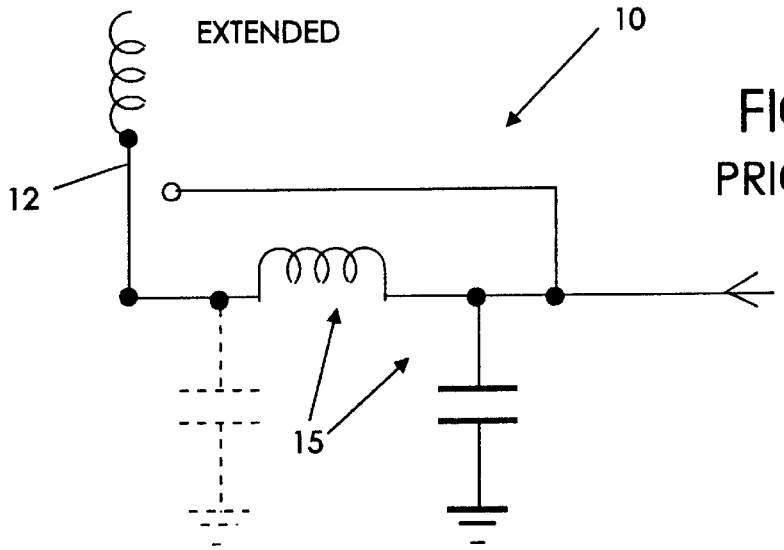
FIG. 1B
PRIOR ART
FIG. 2
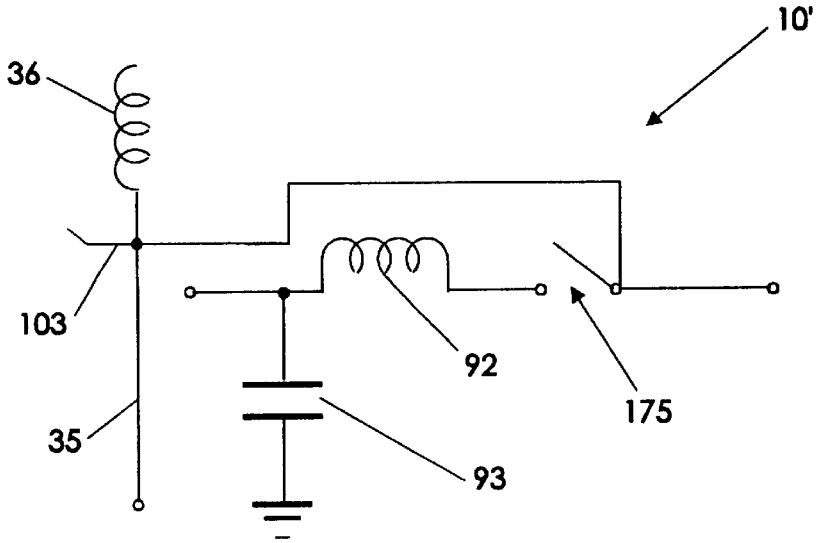

SWITCHABLE MATCHING CIRCUITS USING THREE DIMENSIONAL CIRCUIT CARRIERS

FIELD OF THE INVENTION

The present invention relates to radiotelephones, and more particularly relates to matching circuits for retractable antennas in radiotelephones.

BACKGROUND OF THE INVENTION

Many radiotelephones employ retractable antennas, i.e., antennas which are extendable and retractable in and out of the radiotelephone housing. The retractable antennas are electrically connected to a transceiver operably associated with a signal processing circuit positioned on an internally disposed printed circuit board. In order to maximize power transfer between the antenna and the transceiver, the transceiver and the antenna are preferably interconnected such that the respective impedances are substantially "matched," i.e., electrically tuned to filter out or compensate for undesired antenna impedance components to provide a 50 Ohm impedance value at the circuit feed. Unfortunately, complicating such a matching system, a retractable antenna by its very nature has dynamic components, i.e., components which move or translate with respect to the housing and the printed circuit board, and as such does not generally have a single impedance value. Instead, the retractable antenna typically generates largely different impedance values when in an extended versus a retracted position. Therefore, it is preferred that the impedance matching system alters the antenna's impedance to properly match the impedance of the antenna and the transceiver both when the antenna is retracted and extended.

The physical configuration of the matching network is further complicated by the miniaturization of the radiotelephone and the internally disposed printed circuit board. Many of the more popular hand-held telephones are undergoing miniaturization. Indeed, many of the contemporary models are only 11–12 centimeters in length. Because the printed circuit board is disposed inside the radiotelephone, its size is also shrinking, corresponding to the miniaturization of the portable radiotelephone. Unfortunately, as the printed circuit board decreases in size, the amount of space which is available to support desired operational and performance parameters of the radiotelephone is generally correspondingly reduced. Therefore, it is desirable to efficiently and effectively utilize the limited space in the radiotelephone and on the printed circuit board.

This miniaturization can also create complex mechanical and electrical connections with other components such as the outwardly extending retractable antenna which must generally interconnect with the housing for mechanical support, and, as discussed above, to an impedance matching system operably associated with the printed circuit board in order for the signal to be processed.

Referring to FIGS. 1A and 1B, desired equivalent circuits 10, 10' are illustrated for extended and retracted antenna positions, respectively. As shown, in FIG. 1B, in the extended position the antenna rod 12 operates with a half-wave ($\lambda/2$) load. In this situation, the impedance at the output of the antenna feed may rise as high as 600 Ohms. In contrast, in the retracted position, as shown in FIG. 1A, the antenna rod 12 operates with a quarter-wave ($\lambda/4$) load with an impedance typically near 50 Ohms. Therefore, when the antenna is in the extended position an L-C matching circuit 15 may be needed.

In the past, conventional portable radiotelephones have used a variety of antenna connections to match the impedance in the antenna to the housing and the printed circuit board. For example, U.S. Pat. No. 5,374,937 to Tsunekawa et al. proposes downwardly spaced-apart contacts or terminals on the printed circuit board in the radiotelephone housing which act to engage with or short out the associated matching network. Unfortunately and disadvantageously, this type of switching connection can employ a number of discrete switching components such as wiping contacts and additionally may use an undesirable amount of space on the printed circuit board. Further, this configuration can limit the operational bandwidth of the radiotelephone.

One alternative is described in a co-pending patent application, entitled "Radiotelephones with Antenna Matching Switching System Configurations" by Gerard J. Hayes and Howard E. Holshouser, filed May 20, 1997 (8194-73). This system employs transversely spaced-apart circuit and antenna contacts to reduce the amount of space on the printed circuit board needed to operate the matching system. However, the system employs a number of discrete components in the switching assembly and interconnection of the antenna to the circuit board of the device.

Others have attempted to incorporate discrete printed circuit boards with circuit components at the base of the antenna. Unfortunately, the printed circuit board is generally fragile and thus can lack the durability preferred in a repeated use application. Further, because the RF and ground traces must be isolated from each other, interconnections and required manufacturing tolerances of the appropriate circuit components have further disadvantaged these designs.

OBJECTS AND SUMMARY OF THE INVENTION

It is therefore a first object of the present invention to provide matching systems which can reduce the number of switching contacts and discrete components used to generate a retractable antenna matching system.

It is another object of the present invention to employ an integrated matching system in a way which can combine the mechanical and electrical interface of the antenna assembly to switch and match the antenna's associated impedances.

It is yet another object of the present invention to educe the number of wiping contacts and separate switches and to reduce the amount of printed circuit board space necessary to operate a retractable antenna matching system.

It is a further object of the present invention to provide an antenna base with an integrated circuit which can be conveniently adapted for use with existing radiotelephone models.

It is a still further object of the present invention to provide a reliable, durable, and economical antenna matching circuit.

These and other objects are satisfied by the present invention by a three dimensional circuit positioned on an antenna assembly which integrates a matching circuit with separate RF and ground circuits. A first aspect of the invention includes an antenna assembly configured to define and activate a matching circuit when the antenna is extended. The antenna assembly comprises a a circuit carrier antenna base unit. The base unit includes a predetermined conductive and non-conductive pattern on the outer surface. The base unit also has opposing top and bottom ends and a conductive longitudinal passage extending therethrough. The outer surface conductive portion and the passage define separate signal and ground paths. The antenna assembly also includes a retractable antenna having opposing first and second ends which defines a central axis through the center thereof. The first and second ends include respective first and second conducting portions thereon. The antenna is slidably extendable through the passage about the central axis between a first extended position and a second retracted position. When the antenna is extended the first conducting portion is electrically connected with the antenna base. In a preferred embodiment, the circuit carrier base unit includes a matching circuit disposed thereon such that when the antenna is extended the matching circuit is engaged and activated in the signal path. Preferably, the signal path includes a single RF feed point.

The circuit carrier base unit can also include a disconnecting switch positioned on the top end of the base. The disconnecting switch is configured to contact a conducting portion on the antenna to electrically disconnect the matching circuit when the antenna is in the retracted position, thereby switching the matching circuit out of the signal path when the antenna is retracted. Advantageously, this can disconnect reactive components of the matching circuit thereby enabling a broader radiotelephone operational bandwidth.

In a preferred embodiment, the antenna base component comprises a cylindrical body with an outer surface and a passage with an inner surface. The antenna base includes a circuit carrier disposed on selected portions of the inner and outer surfaces so as to define a first radio signal path and a separate second ground signal path. The passage is configured to receive a portion of a retractable antenna therein. Preferably, the outer surface includes a non-conductive threaded portion with an undercut which helps separate the RF and ground traces. In one embodiment, an upper portion of the threaded surface is conductive and configured for engaging with a ground insert in a radiotelephone housing. The undercut prevents shorting to the ground insert when assembled to the radiotelephone.

Another aspect of the present invention includes a method of forming a carrier circuit defining a signal and separate ground path. Preferably, the carrier circuit is used with a switchable matching system in a radiotelephone retractable antenna base assembly. The method comprises the steps of molding a partial base component of a first layer of a first material and forming a second layer of a second material over selected areas of the first layer. Surfaces of predetermined portions of the base component first layer are maintained externally exposed and the exposed surfaces of the first layer are coated with a conductive coating thereby forming three-dimensional conductive signal and ground circuits on a base component. Preferably, the second layer is formed of a non-catalyzed material and the first layer is formed of a catalyzed material such that the first layer is formed of a material receptive to metallic coatings and the second material is non-receptive to metallic coatings.

Alternatively, a selected surface can be exposed with photoimaging to form a portion of the circuit carrier.

In operation, when the antenna is extended, the antenna and the antenna base form integrated inductive and capacitive matching components. Advantageously, this three-dimensional circuit wraps around the configuration of the support, thus the matching system does not require separate wiping contacts because the mechanical support for the antenna is incorporated with the electrical switching corresponding to the retraction and extension of the antenna within the antenna base.

The foregoing and other objects and aspects of the present invention are explained in detail in the specification set forth below.

BRIEF DESCRIPTION OF THE DRAWINGS

FIG. 1A is a schematic representation of an equivalent circuit of a conventional retracted antenna shown modeled as a quarter-wave stub.

FIG. 1B is a schematic representation of an equivalent circuit of a conventional extended half-wave antenna and an associated L-C matching circuit.

FIG. 2 is a schematic representation of a matching circuit with the L-C components switched out of the circuit when the antenna is retracted according to one embodiment of the present invention.

DESCRIPTION OF PREFERRED EMBODIMENTS

Figure 3:
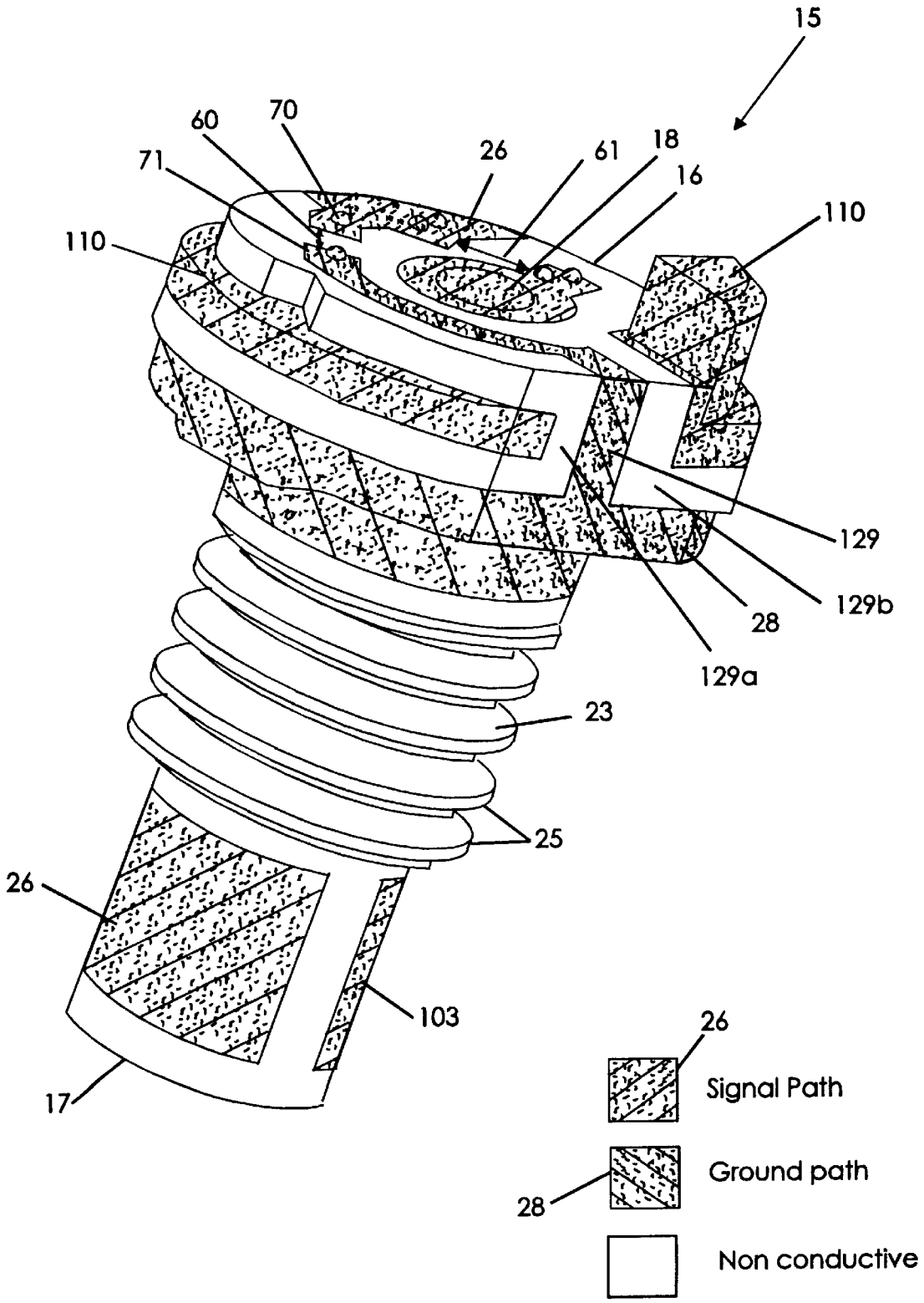
FIG. 3 is an enlarged perspective view of a circuit carrier base unit according to the present invention.

The present invention will now be described more fully hereinafter with reference to the accompanying figures, in which preferred embodiments of the invention are shown. This invention may, however, be embodied in many different forms and should not be construed as limited to the embodiments set forth herein. Like numbers refer to like elements throughout. In the figures, certain thicknesses have been exaggerated for clarity.

Generally described, as illustrated in FIGS. 3, 4, 6A, and 6B, the present invention is directed towards a three-dimensional circuit carrier positioned as an antenna base unit 15. As shown in FIG. 7, the circuit carrier base 15 is preferably for use with radiotelephones 30 with retractable antennas 35. Also preferably, as schematically illustrated in FIGS. 1A and 1B, the retractable antenna 35 employs a top load 36 electrical antenna rod 35 that operates as a half wave in the extended position and a quarter wave stub (helical spiral) in the retracted position. Of course, the invention is not limited to this antenna load or configuration as alternative antenna configurations can also be employed in the instant invention. For example, the antenna can also include an antenna load which has an integer multiple of a half-wave length, or a coil, disc or other type antenna load element. Advantageously, the present invention isolates the RF (signal) and ground traces or paths from the other and switches in various matching components without requiring multiple components such as wiper switches, printed circuit boards positioned in the base and the like.

Figure 4:
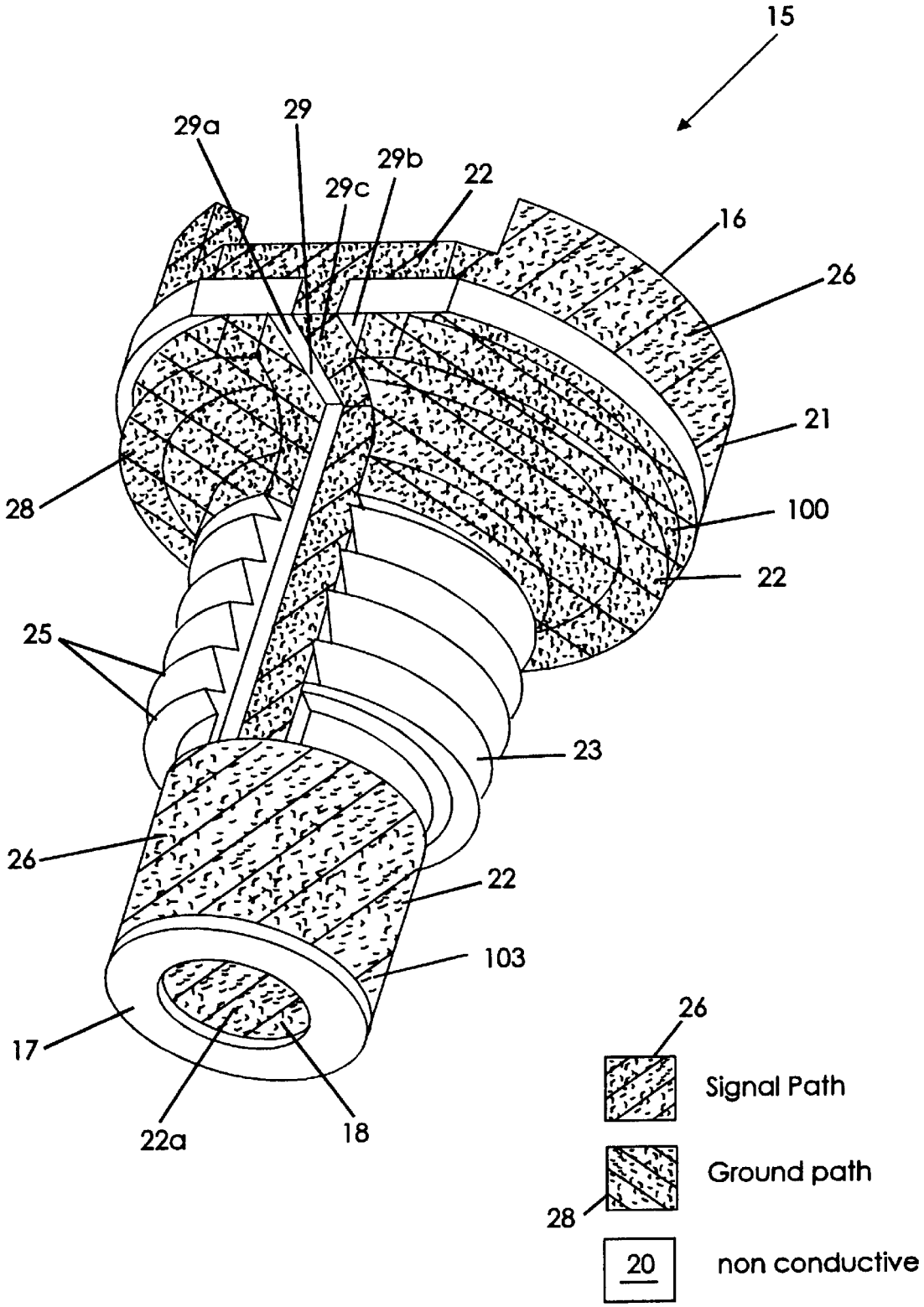
FIG. 4 is an enlarged perspective view of the circuit carrier base unit of FIG. 3, illustrating another side and bottom of same according to the present invention.

As illustrated in FIGS. 3, 4, 6A, and 6B, the antenna base unit circuit carrier 15 is preferably a cylindrical body which includes a matching circuit 40 formed thereon. As shown in FIGS. 3 and 4, the circuit carrier base unit 15 comprises a predetermined conductive and non-conductive pattern on its outer surface 21. The non-conductive portion 23 is shown as a plain material, while the conductive portions 22 are shown as a speckled material. The base component has opposing top and bottom ends 16, 17, and a longitudinal passage 18 extends therethrough. As shown in FIG. 4, the passage includes an exposed inner diameter which preferably is configured with a conductive surface 22*a*. Although shown as conductive along and about the entire length and circumference of the passage, the passage 18 can be alternatively configured with only a predetermined conductive portion (not shown) such that it can carry an electrical signal from the top of the base unit to the bottom when activated with the corresponding antenna conductive portion. The passage 18 is sized and configured to receive a retractable antenna therein. Preferably, as shown in FIGS. 7 and 8, the passage 18 is sized such that the antenna 35 is slidably extendable relative to the passage 18. Also preferably, the passage 18 is sized and configured such that a lower or first conducting portion 75 on the antenna stem 37 electrically and mechanically contacts the inner diameter of the passage 18 when the antenna 35 is extended.

Advantageously, the antenna base component 15 outer surface conductive and non-conductive portions 22, 23, together with the passage 18, define separate signal and ground paths 26, 28 between the antenna 35 and the radiotelephone 30. As shown in FIGS. 3 and 4, the signal path 26 is indicated by the right leaning cross-hatch markings; similarly, the electrically separate ground path is indicated by left leaning cross-hatch markings. FIGS. 3 and 4 illustrate different side perspective views of one embodiment of the present invention. These two views illustrate the pattern of conductive material surfaces 22 (shown as speckled) interposed with non-conductive surfaces 20 (shown as unadorned and plain). This configuration, even in a small (i.e., 8–13 mm diameter) base unit body 15, electrically separates each of the ground and signal paths 28, 26 from the other. Preferably, the base component includes a single signal or RF feed 103 along the signal path 26. As shown in FIGS. 3 and 4, the signal feed 103 circumferentially extends around a bottom portion of the base unit 15.

Figure 6B:
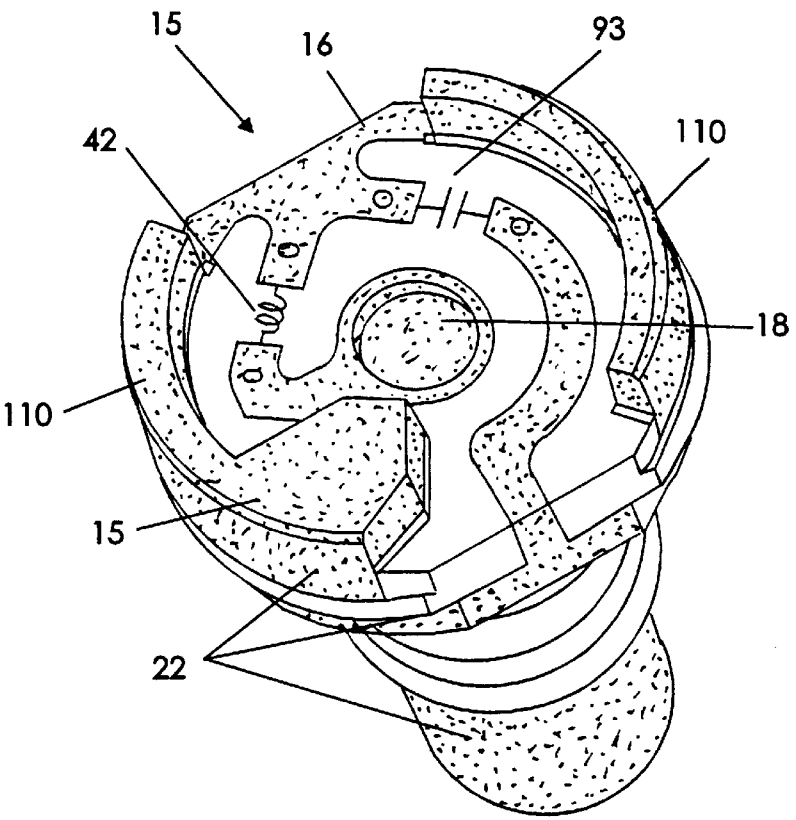
FIG. 6B illustrates another side of the carrier circuit assembly of FIG. 6A.
Figure 6A:
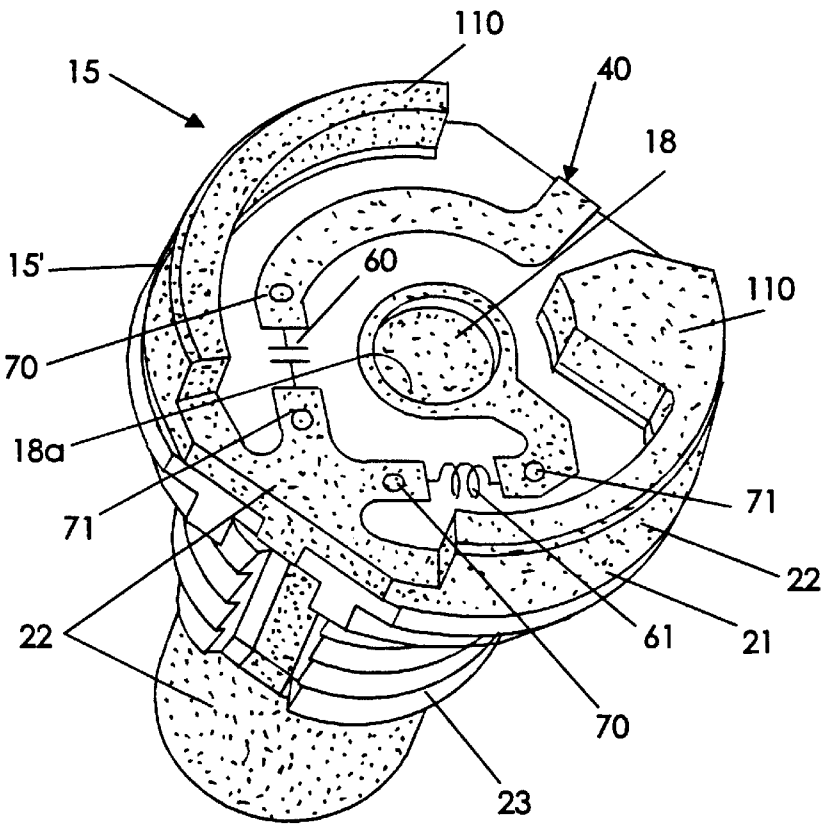
FIG. 6A is an enlarged perspective view of a carrier circuit assembly according to one embodiment of the present invention.
Figure 7:
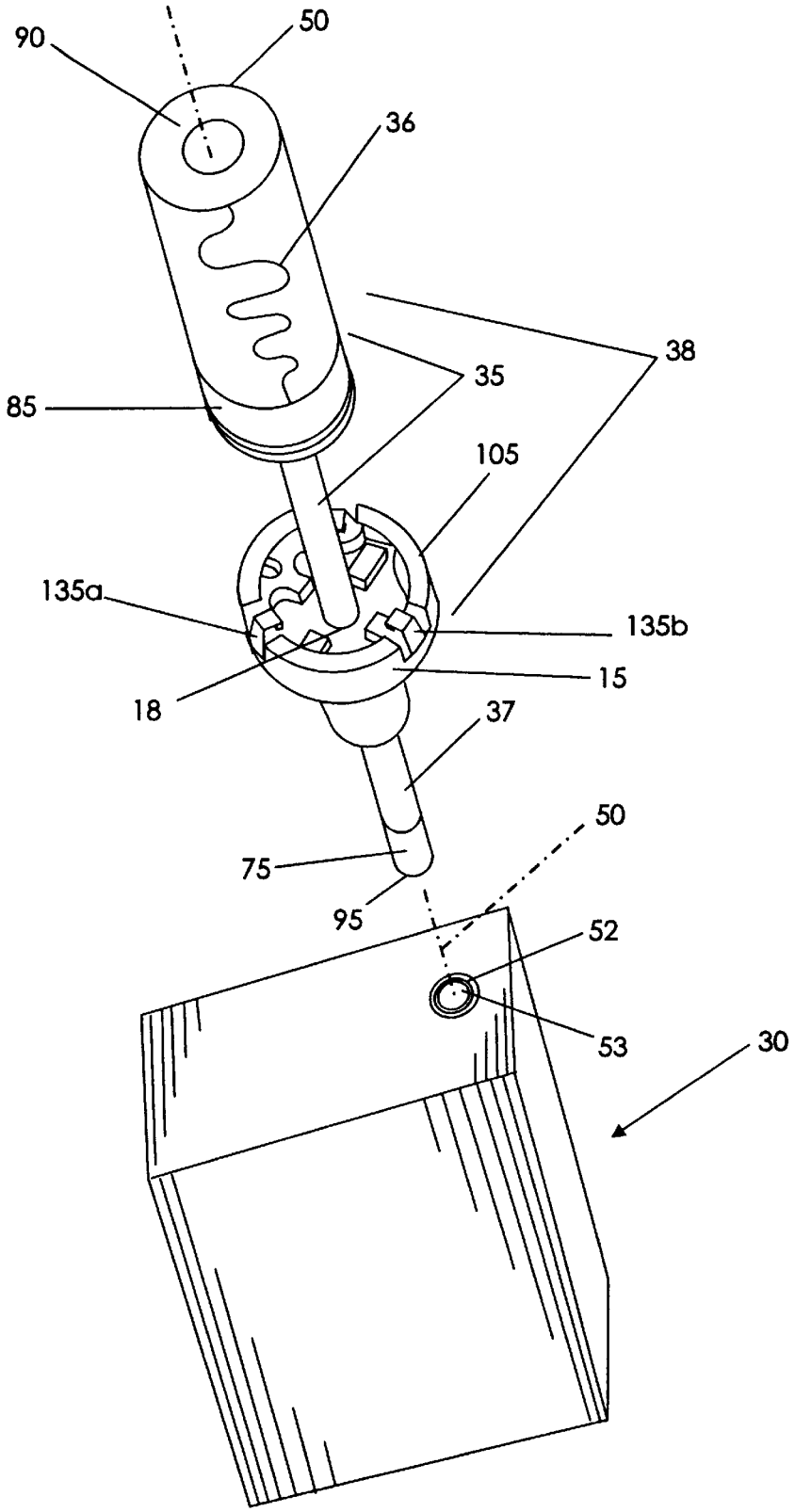
FIG. 7 is an exploded view of a radiotelephone and antenna with an additional embodiment of a carrier circuit according to the present invention.

As shown in FIGS. 3, 6A, and 6B, the base unit 15 also preferably includes two spaced apart cavities 60, 61 or gaps positioned on the top surface 16 of the base unit 15 between the signal and ground portions for assembly of discrete circuit components therein. Of course, as will be recognized by one of skill in the art, depending on the type of antenna desired (such as single or dual band, etc. . . . ), the trace can include only one gap, more than two gaps, or be formed without gaps such as to include the inductor as part of the circuit trace. This latter situation can eliminate the need for discrete components.

Further preferably, the base unit 15 includes upwardly extending electrical contact protrusions 70, 71 on opposing sides of the cavities or gaps 60, 61 which can facilitate the proper positioning of the matching components 40 such as discrete inductor or capacitor components 92, 93 (FIG. 6A). Referring to FIG. 4, the ground path 28 is configured in the base unit 15 such that it electrically contacts with a ground in the radiotelephone at a position intermediate the top and bottom 16, 17 of the base unit 15 (the ground contact surface 100).

As shown in FIG. 4, the signal path 26 extends from the top 17 of the base unit 15 along and about an external signal trace 29*c* which is positioned along the external length of the base component 15 and is separated from the intermediate ground contact surface 100 by an undercut 29 flanked by non-conductive portions 29*a*, 29*b* adjacent the ground contact surface 100. Similarly, as shown in FIG. 3, the ground path 28 rises to the top 16 of the base unit by a trace 129 separated from the signal path 26 by non-conductive portions 129*a*, 129*b*. Alternative ways of implementing the circuit traces can also be employed. For example, vias can be used to direct and connect the traces. A via can be generally described as a plated hole which electrically connects two layers (not shown). Of course combinations of vias used with the circuit traces described above can also be employed (not shown). For example, a via can replace a trace which wraps around a corner, such as from the top of the base unit to the underside of the base unit, effectively shortening the electrical path, potentially improving electrical characteristics of the path thereby (not shown).

In a preferred embodiment, as illustrated in FIG. 7, when assembled, the antenna base unit 15 is threadably inserted into an aperture in the housing 53 such that portions of the threads 25 (FIG. 3) on the base component 15 engage with a ground insert 52 positioned on the aperture 53 in the radiotelephone 30 thus electrically connecting a ground to the base unit 15.

Figure 8A:
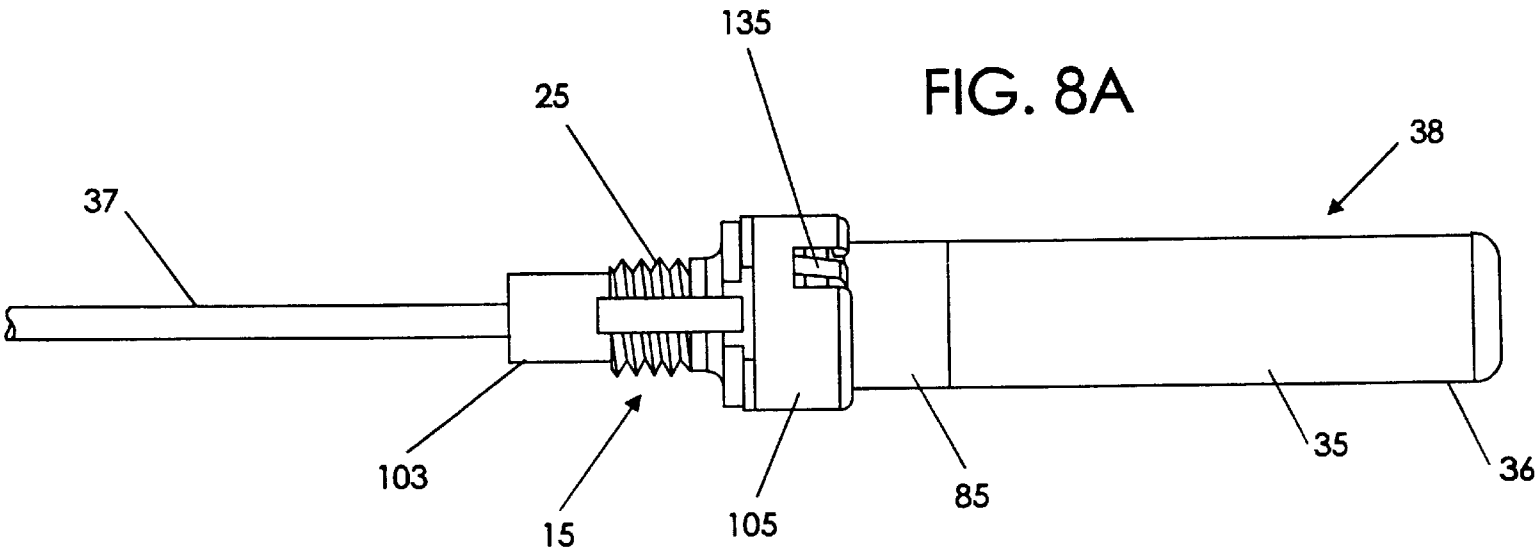
FIG. 8A is a side view of one embodiment of an antenna assembly according to the present invention.

Turning to FIG. 8A, the antenna base unit circuit carrier 15 is sized and configured to engage with the retractable antenna 35 and is preferably configured to switch and electrically include one or more matching circuit components in the signal path depending on the position of the antenna 35 within the carrier base unit 15. Stated differently, the antenna base unit 15 is configured to automatically engage a matching system 40 (FIG. 6A) corresponding to the extension of the antenna. Accordingly, the matching system 40 has different circuit paths and associated impedances corresponding to predetermined positions of the translating antenna 35, i.e., corresponding to the retracted or extended position of the antenna 35 relative to the antenna assembly 38 positioned in the radiotelephone housing 30.

It will be appreciated that when the antenna 35 is extended, a major portion of the antenna body is outside of the radiotelephone housing 30; in contrast, when the antenna 35 is retracted, a major portion of the antenna body 35 is positioned inside the radiotelephone housing 30. In operation, the antenna 35 extends in and out of the housing passage 53 (FIG. 7) along the central axis 50 and engages with the base unit 15 (assembled to the housing 30) such that different signal paths are defined and activated by the position of the antenna 35 within the antenna base unit 15 corresponding to the retraction and extension of the antenna as will be discussed in more detail hereinbelow. The radiotelephone also includes a printed circuit board (not shown) disposed in the housing adjacent the antenna 35 to electrically connect the signal or RF feed 103 from the base 15 to the radiotelephone 30. As will be appreciated by those of skill in the art, the printed circuit board is configured to receive (and transmit) an electrical signal from the antenna 35 and base unit 15.

Referring to FIG. 7, the antenna 35 includes first and second conducting portions 75, 85 which engage with the antenna base unit 15 to activate the corresponding signal path, i.e., the extended or retracted signal path, depending on the extension or retraction of the antenna 35 relative to the antenna base unit 15. Preferably, the retracted and extended signal path operates with a 50 Ohm impedance into a signal feed associated with the printed circuit board in the radiotelephone 30. The extended signal path includes a matching system 40 (FIG. 6A) which matches the increased impedance attributed to the extended position of the antenna 35.

As described above, the passage 18 and the antenna 35 are matably configured so that activation of the matching circuitry 40 occurs with the physical retraction and extension of the antenna 35. This configuration advantageously reduces the amount of space on the printed circuit board needed or dedicated to activate the corresponding matching circuit components.

Referring again to FIG. 7, in operation, the antenna 35 extends along the central axis 50 in and out of the base unit passage 18. The base unit 15 is configured to assemble to the housing via the housing opening 53 (FIG. 7). Preferably, the electrical length of the antenna 35 (typically defined by the top load element 36 and the length of the linear rod 37) is predetermined. Further preferably, the electrical length of the antenna 35 is configured to provide a half wavelength or an integer multiple of a half wavelength so that the antenna 35 resonates at the operational frequency. As illustrated in FIG. 7, the antenna 35 includes opposing first and second ends 90, 95 and defines a central axis 50 through the center thereof. The first end 90 extends out of the housing 30 and includes the top load antenna element 36, such as a top load monopole. As described above, the antenna 35 also includes a second conducting portion 85 positioned below the antenna element 36.

Figure 8B:
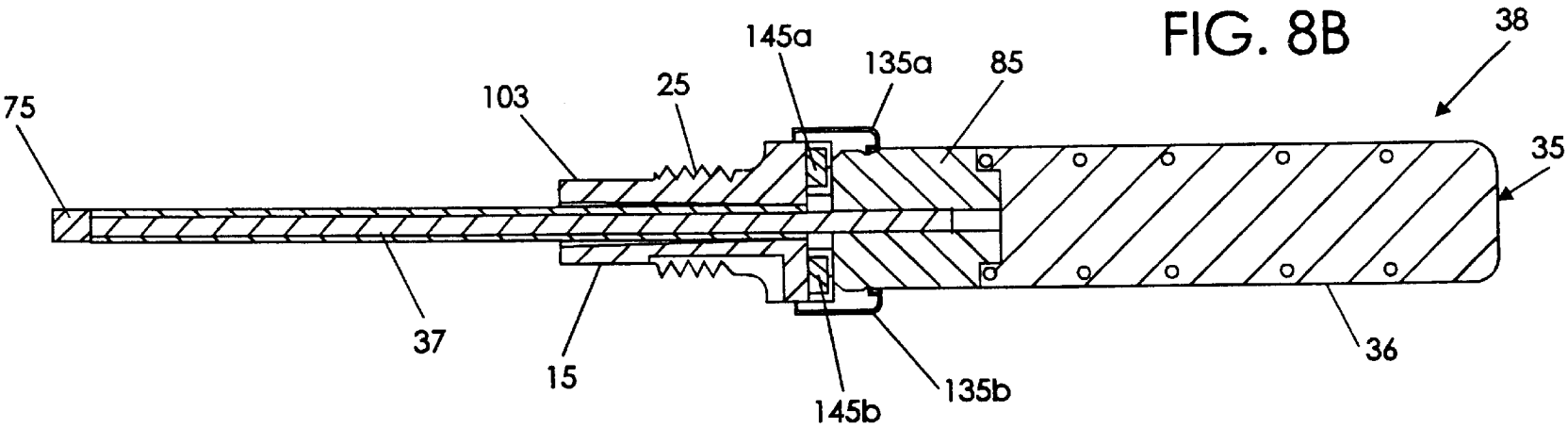
FIG. 8B is a sectional view of the antenna assembly of FIG. 8A.
Figure 11:
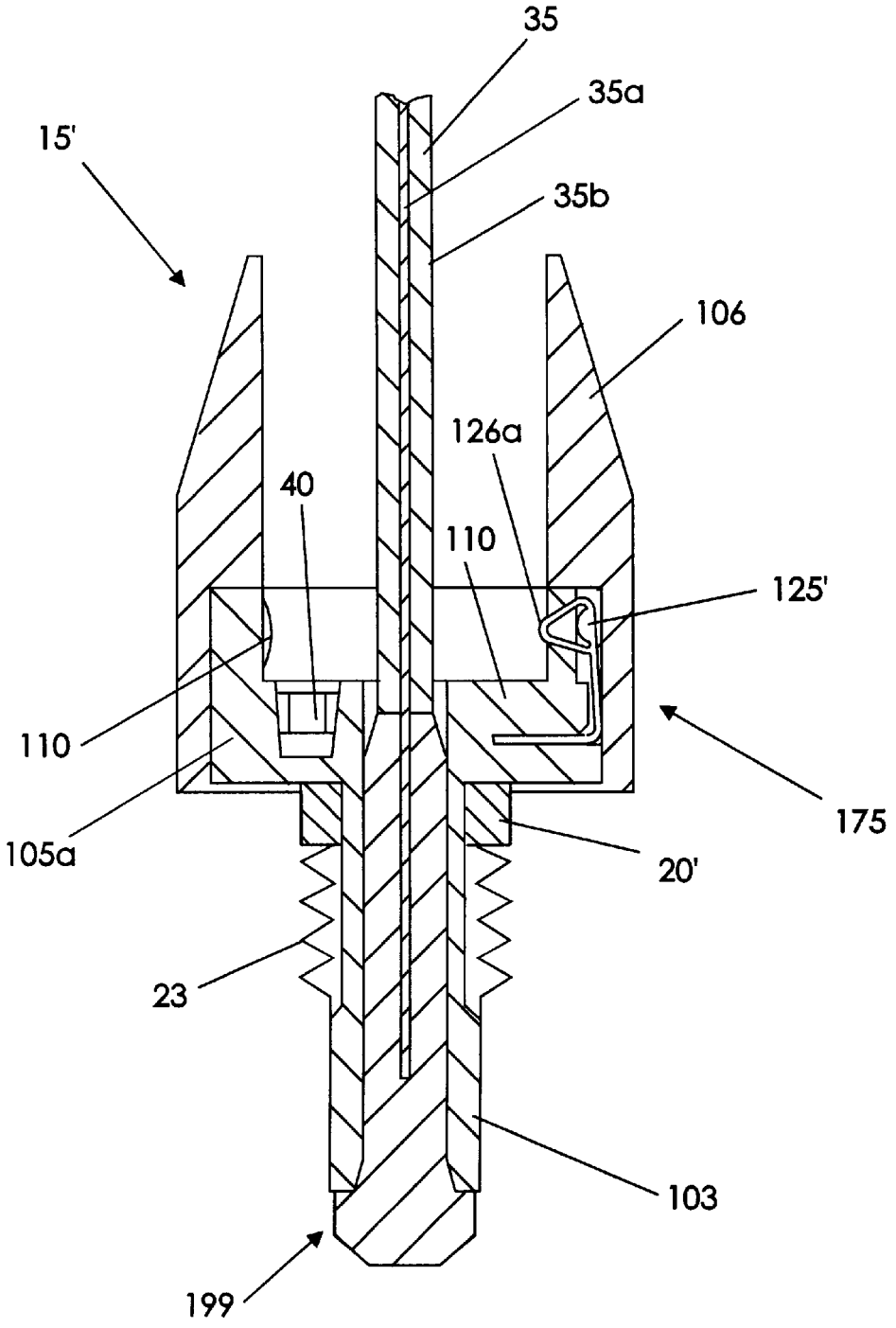
FIG. 11 is a sectional view of an antenna assembled within the carrier circuit illustrated in FIG. 9A.

FIG. 11 shows the antenna 35 in the extended position and FIGS. 8A and 8B show the antenna 35 in the retracted position. As shown in FIGS. 8A and 8B, the second conducting portion can be a conducting contact ring 85 electrically connected to the top load antenna element 36. Also as shown in FIGS. 8A and 8B, the contact ring 85 is exposed on the outer diameter of the antenna 35 for a length sufficient to engage one or more of the contact(s) or contact surfaces 110 on the base unit 15.

Referring again to FIG. 7, in a preferred embodiment, the second end of the antenna 95 includes a first conducting portion 75 which is electrically connected to and formed over (at least a portion of) the linear rod element 37 below and spaced apart from the second conducting portion 85. The first conducting portion 75 is configured to electrically connect with the rod 37 and a top portion of the inner surface of the passage 18 when the antenna is extended so as to transmit and receive the signal therebetween. The lower antenna end 95 preferably remains within the antenna base unit 15 irrespective of the extension of the antenna 35. The antenna end 95 or contact 75 can include integral spring features or configurations (not shown) to facilitate contact with the top portion 18*a* (FIG. 6A) of the inner surface of the passage 18 upon extension of the antenna 35. As shown in FIG. 11, the antenna 35 can also be configured with an anchor portion 199 so as to anchor or retain the end inside the antenna base to prevent inadvertent withdrawal of the antenna rod from the housing 30. In any event, as shown in FIGS. 7 and 11, the antenna is preferably configured such that the antenna top load element 36, second conducting portion 85, and first conducting portion 75 are in electrical communication.

As illustrated in FIGS. 6A and 6B, when the antenna is extended, the base unit 15 and antenna 35 are configured to engage the matching system 40 which preferably includes an inductor 92 and a capacitor 93. In a preferred embodiment, the inductor 92 and capacitor 93 are discrete components positioned on the top surface 16 of the base unit 15 such that they are in the signal path 26 when the antenna is extended. Preferably, the capacitor is sized to provide about a ½–1 picofarad capacitance. An exemplary sized component footprint for the embodiment shown is commonly known to those of skill in the art as "0603". Further preferably, as shown in FIGS. 6A and 6B, the matching circuit 40 includes both an inductor and a capacitor, but the invention is not limited thereto. Indeed, the matching system 40 can alternatively be configured to selectively match either the impedance of the inductive or the capacitive portion of the signal. Resistive components may also be added, either external to, or integral with, the capacitive and inductive components.

A typical antenna configuration is shown in FIG. 11. As shown, the antenna rod 37 includes a conductive core 35*a* and a non-conductive overmold 35*b*. Thus, it will be appreciated that, in a preferred embodiment as shown in FIG. 7, when the antenna 35 is extended, the radiotelephone signal is transmitted (and received) from the antenna 35 via a signal path defined by the antenna top element 36, the extended rod 37 (core), and the first conducting contact 75. The extended rod 37 first conducting portion 75 engages (mechanically and electrically) with the inner surface of a top portion 18*a* of the passage 18 (FIG. 6A) and activates the matching circuit 40 on the top surface of the base unit 15 including the inductor 92 and capacitor 93. The signal is directed through the matching circuit 40 down the external trace 29*c* (FIG. 4) to the signal or RF feed 103 and into the radiotelephone 30. This signal feed 103 is electrically connected with the printed circuit board or other substrate in the radiotelephone which processes the radiotelephone signal (not shown).

Referring to FIG. 7, the antenna second conducting portion 85 electrically connects to the helical spiral 36 (such as a quarter-wave spiral) positioned at the top of the antenna 35. Thus, when retracted, the antenna second conducting portion 85 connects to, and electrically contacts, selected contact surfaces 110 on the top surface 16 of the base component 15 (FIGS. 6A, 6B). This engagement directs the signal down the external trace 29*c* without electrically engaging the matching circuit 40 (such as by shorting these circuit components out of the signal path), thus creating a retracted signal path. Preferably, the retracted signal path operates with a 50 Ohm impedance. Thus, as shown in FIGS. 8A and 8B, the retracted signal path is defined by the antenna helix 36, the antenna second conducting portion 85, the base unit upper contacts 135*a*, 135*b* (electrically associated with base contact surfaces FIG. 3, 110), the base unit external trace 29*c*, and the signal feed 103.

Of course, connection to and configuration of the shorting or upper contact surfaces 110 (FIG. 3) of the base unit 15 may be made in various other ways. FIGS. 7 and 8 show a metal contact ring 105 mechanically connected to the base unit 15, such as by soldering or press-fitting the ring 105 to the base 15. Thus, when retracted, contact features 135*a*, 135*b* contact the antenna conducting portion 85 to short the matching circuit 40 and direct the signal down the base component 15 into the radiotelephone. Other alternative contact surface configurations include molding desired features in the base unit 15 in a predetermined contact geometry (FIG. 9) or by positioning the contact features 110 as discrete components on the base unit 15. In a preferred embodiment, the contact such as the metal contact ring 105 shown in FIG. 8 includes spring fingers 135 which facilitate electrical contact with the antenna conducting portion 85.

Figure 9B:
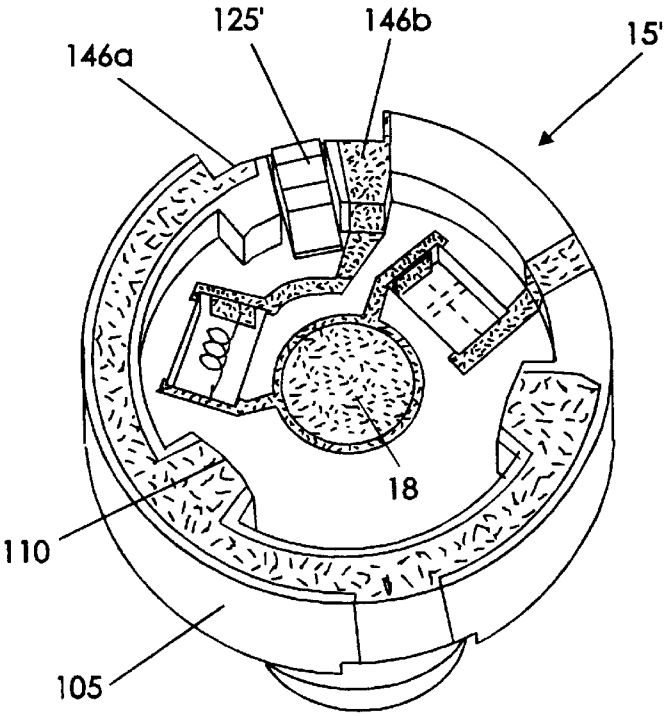
FIG. 9B is a top perspective view of the opposing side of the carrier circuit illustrated in FIG. 9A.
Figure 9A:
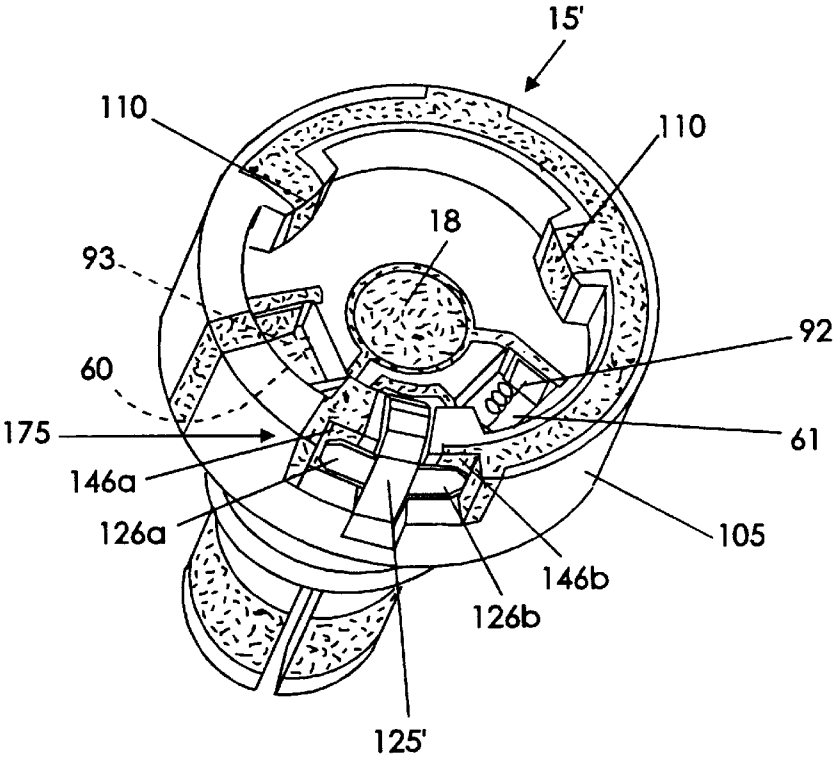
FIG. 9A is a top perspective view of an additional embodiment of a carrier circuit according to the present invention.
Figure 10:
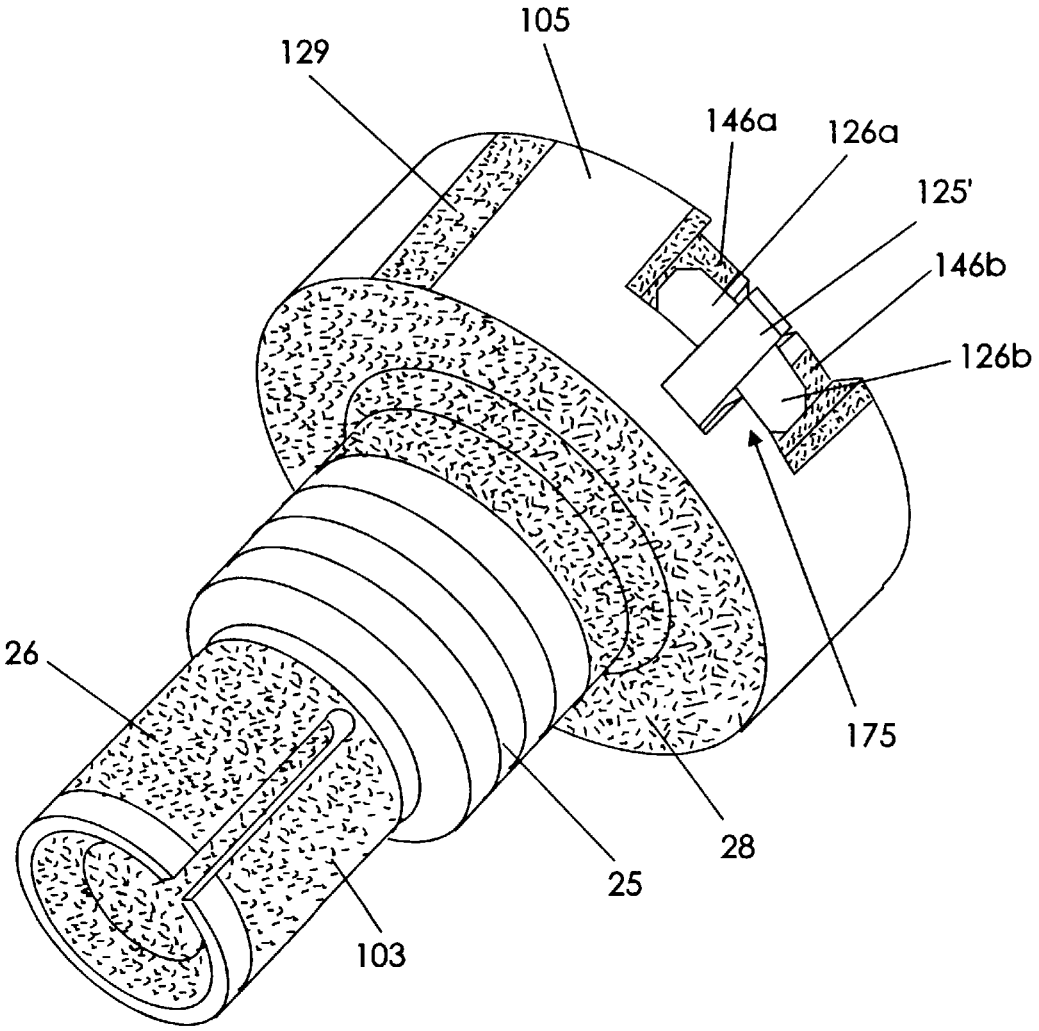
FIG. 10 is a bottom perspective view of the carrier circuit of FIG. 9A.

Further, in an additional embodiment as illustrated by FIGS. 9, 10, and 11, when retracted, the antenna 35 and the base unit 15 can be configured to provide a switching mechanism 175 to switch out the matching components and circuitry 40. Thus, in contrast to the embodiments shown in FIG. 7 and 8, which act to short across the matching components 40 (similar to the electrical diagram shown in FIG. 1A), this embodiment (similar to FIG. 2) switches the matching circuit 40 out of the signal path. Advantageously, switching out the matching circuit can improve certain operational characteristics by eliminating reactive components from the signal circuit, such as a providing a broader operational bandwidth.

Referring to FIG. 11, when the antenna is retracted, the base unit 15' is configured to switch out the matching circuit 40 by contact with the second conducting portion 85. As shown, the antenna base unit 15' includes a (preferably spring loaded) switch contact 125'. The base unit 15' also includes an electrical contact portion with surfaces 110 which are configured to electrically engage the top load of the antenna 36 via the antenna second conducting portion 85. The switch contact 125' is shown as a transversely extending spring contact, i.e., the spring switch contact 125' is moveable towards and away from the central axis 50. The switch contact 125' is preferably configured and positioned on the base unit 15' such that it defines a normally closed switch with the matching circuit 40. As such, in this embodiment, when the antenna 35 is extended, this contact configuration will operate as the embodiments previously described, i.e., the lower contact 75 on the antenna electrically contacts the inner surface 18 of the base unit 15' to engage the matching circuit 40. However, as schematically illustrated in FIG. 2, when the antenna 35 is retracted, the switch contact 125' and the base unit 15' are configured as a switching mechanism 175 to electrically switch out the matching circuit 40.

Referring to FIGS. 9 and 10, the contact 125' includes a pair of fingers which circumferentially extend in opposing directions 126*a*, 126*b* and which are configured to engage with conductive surfaces on the base unit 146*a*, 146*b*, respectively, when the antenna 35 is extended. This configuration provides electrical continuity with the matching circuit 40 included in the signal path when the antenna 35 is in the extended position. The switch contact 125' is typically pressed into a cavity and heat-staked to retain it in the base 15'. Preferably, the contact is resilient and formed from phosphor bronze, beryllium copper or other material having spring-like properties. Alternatively, the contact 125' can be configured into the integral base component 15', using a polymer material of one embodiment of the base unit 15' as a natural type spring, the material used can be designed for fatigue and creep concerns.

Preferably, as discussed above, the switch contact 125' is normally closed such that it is in the signal path and in electrical communication with the matching circuit 40 when the antenna 35 is extended. Also preferably, the base unit 15' includes a pair of contact pads 146*a*, 146*b* positioned opposite the spring contact 125' such that the spring contact fingers 126*a*, 126*b* engage the corresponding pad 146*a*, 146*b* when the antenna 35 is extended to provide electrical continuity in the signal path.

As shown in FIG. 9A, the switch spring contact 125' is pushed outward and the fingers 126*a*, 126*b* displaced and electrically separated from the contact pads 146*a*, 146*b* by the movement of the second conducting portion 85 of the antenna (positioned below and adjacent the helix 36). The antenna helix 36 and conducting portion 85 are wider than the stem or rod 37 of the antenna. Thus, when the antenna 35 is retracted this additional width pushes against the contact 125' breaking contact with the signal path and opening the normally closed switch defined by the base unit 15' configuration of this embodiment. Thus, in this embodiment, when the antenna is retracted, the second conducting portion 85 contacts the contact surfaces 110 on the base 15', displaces the spring contact 125' which disconnects the fingers 126*a*, 126*b* from the contact pads 146*a*, 146*b* and electrically switches the matching circuit 40 thereby. In contrast, as described above, when the antenna 35 is extended, the matching circuit 40 is engaged via the normally closed position of the spring contact 125'. Of course, one of skill in the art will understand that there are many ways to implement the instant invention and a variety of variations and configurations can be employed to provide the desired matching and switching capacity between the base unit 15 and the antenna 35.

FIG. 7 illustrates the base unit 15 with an outer guide 105 positioned around the circumference of the top surface 16 of the base unit. The outer guide 105 helps guide the antenna in proper alignment and is conductive. As such, the outer guide 105 assists in electrically contacting the corresponding antenna contacts when the antenna is retracted. Similarly, FIG. 11 includes a ring 105*a* formed into the circumference of the top surface of the base unit. The ring 105*a* can be non-conductive with conductive portions 110 included thereon.

In addition, the base (as shown in FIG. 11) can include a sheath 106 positioned around the top surface of the base unit. The sheath can aesthetically enhance the appearance of the unit, help guide the retraction and extension of the antenna, and protect the components thereon. Preferably, the sheath illustrated in FIG. 11 106 is a polymer sheath positioned over the base 15' to provide an aesthetic finish and to protect the circuitry such as the shorting contacts, the electrical components, and the contact pads. Similarly, the matching components 92, 93 can be overcoated with a protective coating to insulate and provide environmental protection.

Figure 5A:
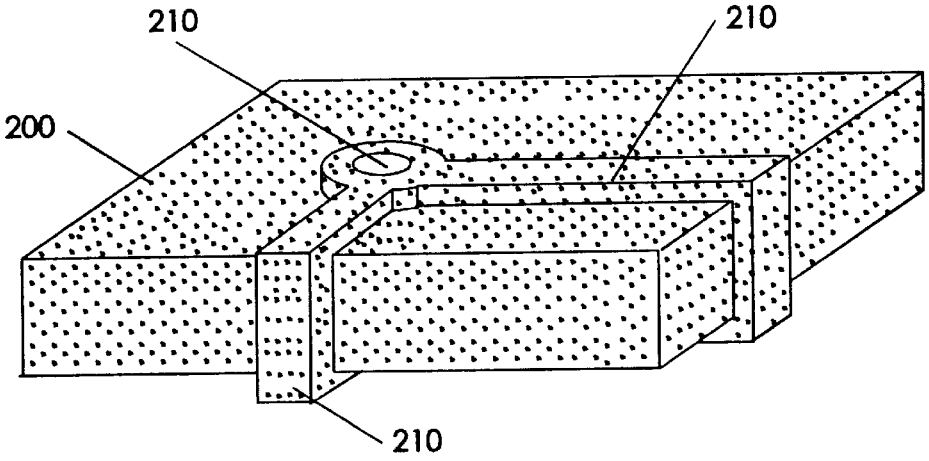
FIG. 5A is a perspective view of a first stage molding process illustrating predetermined raised surfaces on a sub-component carrier circuit according to one aspect of the present invention, the raised surfaces will be conductive in a finished part as shown in FIG. 5C.
Figure 5B:
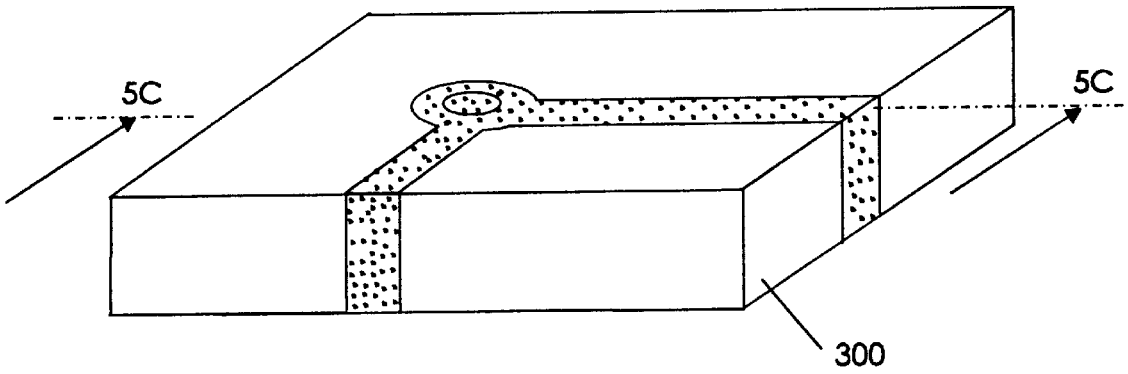
FIG. 5B is a perspective view of a second stage of a molding process illustrating the molded part of FIG. 5A with additional material molded over predetermined areas of the first sub-component.
Figure 5C:
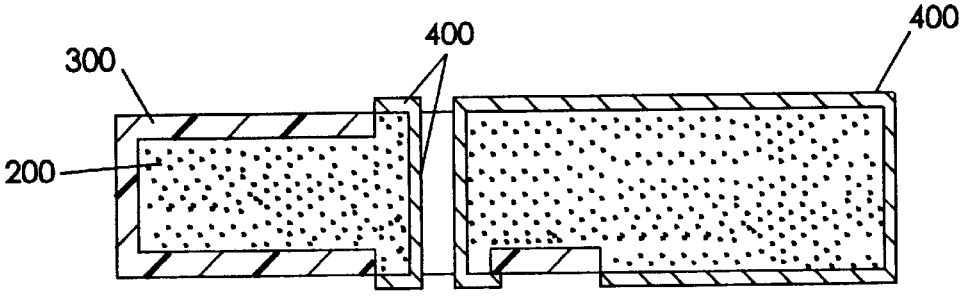
FIG. 5C is a sectional view of the part illustrated in FIG. 5B after the part has been metallically plated according to one embodiment of the present invention.

Turning now to FIGS. 5A, 5B, and 5C, a preferred method of fabricating a three-dimensional circuit carrier (and more preferably an integral base unit including and defining the circuit carrier) is illustrated. In this embodiment, a two-shot molding process is used to form the configuration of the base component 15. Two materials or material compositions are preferably used, one with an affinity for conductive coatings and one without such affinity, the first material used in the first shot and the second in the second shot. Examples of materials which can be used include, but are not limited to, polymers with and without catalysts, such as liquid crystal polymer, ULTEM™, and NYLON™, or materials which are platable with a non-platable material; for example, various grades of NYLON™.

Preferably, in the first shot (FIG. 5A), a catalyzed polymer material is molded in a first layer 200 in manner and configuration which provides exposed surfaces 210 desired to be conductive in the end component. These exposed surfaces 210 can then be subsequently processes such as by plating metallic or conductive coatings after the second mold shot 300 is disposed onto the first mold shot. In the second shot (FIG. 5B), the second material such as an uncatalyzed polymer is molded in a second layer 300 over surfaces in which conduction is not desired, and in a manner which leaves the catalyzed polymer of the first layer 200 exposed on surfaces 210 where plating and the like is desired. After molding, the part can be plated or coated (FIG. 5C) with a third layer 400. The coating adheres only to the surfaces 210 with an affinity for the coating, thereby creating a conductive and non-conductive 400, 300 pattern desired to define the separate signal and ground paths thereon. As will be understood by one of skill in the art, other processes may be employed with the two-shot process to add to or complement the desired conductive and non-conductive trace pattern, such as, but not limited to, one or more of dipping, plating, or painting the desired surface treatment thereon. In a preferred embodiment, an electrolysis plating deposit is placed on the exposed catalyzed features. Typical electroless and electroplate materials include copper, nickel, tin, and gold.

Alternatively, one may employ a photoimaging or electroplating and photo-resist technique by using multiple exposures to form the desired structure. Of course, combinations of photoimaging and the two-shot molding process can also be used. For example, circuits that wrap around edges may be formed using the two-shot process, while higher resolution circuit patterns on one surface could be added using photo-imaging.

As will be appreciated by those of skill in the art, certain of the above described aspects of the present invention may be provided by hardware, software, or a combination of same. Thus, while the various components have been described as integrated elements, one or more may, in practice, be implemented by a microcontroller including input and output ports running software code, by custom or hybrid chips, by discrete components or by a combination of the above. For example, one or more components of the matching circuit 40, can be a implemented as a programmable controller device or as a separate discrete component (as illustratively described throughout). Similarly, the term "printed circuit board" is meant to include any microelectronics packaging substrate.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clause are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An antenna assembly, comprising:

a circuit carrier antenna base unit, said circuit carrier antenna base unit comprising opposing top and bottom ends and an outer perimeter surface, said top end including an upper surface, and a conductive longitudinal passage extending between said opposing top and bottom ends, said circuit carrier antenna base unit having a predetermined conductive and non-conductive pattern formed thereon, wherein said predetermined conductive and non-conductive pattern is arranged on said upper surface, said outer perimeter surface, and said passage to define separate signal and ground paths thereon such that both said signal and ground paths are positioned on a portion of said upper surface and are also configured to extend from said upper surface to a position on said circuit carrier base unit which is below said upper surface; and a retractable antenna having opposing first and second ends and defining a central axis through the center thereof, said first and second ends including respective first and second conducting portions thereon, said antenna slidably extendable through said conductive longitudinal passage along said central axis between a first extended position and a second retracted position; wherein when said antenna is in said extended position, said first conductive portion is electrically connected with said circuit carrier antenna base unit.

2. An antenna assembly according to claim 1, wherein said circuit carrier base unit includes a matching circuit thereon, and wherein when said antenna is extended said matching circuit is engaged in said signal path upon contact between said circuit carrier base unit and said antenna first conductive portion.

3. An antenna assembly according to claim 2, wherein said signal path includes a single RF feed point.

4. An antenna assembly according to claim 2, wherein said matching circuit includes a discrete inductor and a capacitor.

5. An antenna assembly according to claim 2, wherein said base top end further includes a circuit switch contact and at least one corresponding switch contact surface, wherein said switch contact and said switch contact surfaces are electrically normally closed such that the signal path is electrically engaged with said matching circuit when said antenna is extended, and wherein said switch contact and said switch contact surfaces are disengaged when said antenna is retracted and configured to electrically switch said matching circuit out of the signal path.

6. An antenna assembly according to claim 2, wherein said antenna includes in longitudinal serial order, a top load element, a second conductor, and a first conductor, each in electrical communication with said top load element.

7. An antenna assembly according to claim 2, wherein said antenna and said base are configured to be inserted into a radiotelephone housing to provide a first impedance when said antenna is extended and a second impedance when said antenna is retracted.

8. An antenna assembly according to claim 7, wherein when said antenna is extended, said passage inner diameter contacts said antenna first conductive portion thereby electrically engaging said matching circuit, and wherein when said antenna is retracted said second conducting portion is a contacting ring positioned adjacent the bottom of said antenna top load element and electrically connects said base top to said antenna such that said matching circuit is shorted out of the signal path.

9. An antenna assembly according to claim 8, wherein said base unit further comprises:

a disconnecting switch positioned on said base top, said disconnecting switch configured to contact said antenna contact ring and electrically disconnect said matching circuit from the signal path when said antenna is in the retracted position, thereby switching said matching circuit out of said signal path when said antenna is retracted.

10. An antenna assembly according to claim 1, wherein when said antenna is retracted said second conducting portion is electrically connected to the top of said base such that said matching circuit is not engaged.

11. An antenna assembly according to claim 1, wherein said base non-conductive material is a polymer.

12. An antenna assembly according to claim 11, wherein said base material is one of a liquid crystal polymer, ULTEM, and NYLON.

13. An antenna assembly according to claim 1, wherein said base conductive and non-conductive pattern includes catalyzed and non-catalyzed material.

14. An antenna assembly according to claim 1, wherein said conductive pattern is defined by a plated catalyzed material.

15. An antenna assembly according to claim 1, further comprising an upwardly extending sheath positioned around the upper end of said base.

16. An antenna assembly according to claim 1, wherein said base unit includes a threaded portion intermediate said top and bottom ends for mounting to a radiotelephone housing.

17. An antenna assembly according to claim 16, wherein said top end upper surface of said base includes an opposing externally accessible underside, wherein said threaded portion mechanically engages with a ground insert disposed in said radiotelephone housing, and wherein said underside of said upper surface of said base electrically contacts with said ground insert.

18. An antenna assembly according to claim 1, said antenna further including a longitudinally extending rod portion intermediate said top loaded element and said first conducting portion, wherein said matching circuit is activated in the extended position by electrical contact between said antenna first conducting end portion and the inner diameter of said base, and wherein said top load element, said antenna rod, and said base define a signal path therebetween.

19. An antenna assembly according to claim 1, wherein when said artenna is in the retracted position said antenna and said base are configured to disconnect reactive components of said matching circuit thereby enabling a broader radiotelephone operational bandwidth.

20. An antenna assembly according to claim 1, wherein said circuit carrier base unit is defined by a primary unitary body, and wherein said conductive and non-conductive pattern is formed thereon such that said outer perimeter surface is configured with both said signal and ground paths thereon, and wherein said longitudinal passage includes a conductive portion formed thereon, and wherein said conductive pattern on said primary unitary body is configured to provide sufficient electrical separation between said signal and ground paths when operatively engaged with said retractable antenna and internal radiotelephone operating circuitry.

21. An antenna assembly according to claim 20, wherein said circuit carrier base unit is configured as a cylindrical body, said top end comprising opposing upper and lower laterally extending surfaces positioned on said circuit carrier base unit such that said upper and lower laterally extending surfaces radially extend away from said antenna a greater distance than the remainder of said cylindrical body, and wherein said upper and lower laterally extending surfaces are spatially separated a width defined by a first longitudinal segment formed therebetween, and wherein said conductive and non-conductive pattern is formed on said carrier base unit such that both said signal and ground paths extend along the outer perimeter surface of each of said upper and lower laterally extending surfaces, said first longitudinal segment, and said cylindrical body portion.

22. An antenna assembly according to claim 21, wherein said cylindrical body portion includes a threaded outer portion, and wherein said circuit carrier base unit includes an undercut which longitudinally extends along said threaded portion and into said lower laterally extending surface.

23. An antenna assembly according to claim 1, wherein said circuit carrier base unit is a miniaturized component configured to longitudinally extend proximate to said antenna, and wherein said conductive pattern is formed as a surface pattern.

24. An antenna assembly according to claim 1, wherein said retractable antenna translates and directly contacts said longitudinal passage of said circuit carrier base unit when said antenna is in said extended position, and wherein said direct contact engages a signal path which includes a matching circuit formed in said top end of said circuit carrier antenna base unit.

25. An antenna assembly according to claim 24, wherein said circuit carrier base unit is configured to threadably attach to a ground insert in a radiotelephone.

26. An antenna base component comprising:

a cylindrical body having a top cap portion, an outer perimeter surface, and a loneitudinally extending passage formed therethrough said cylindrical body passage having a conductive surface;

a conductive surface circuit pattern disposed on selected regions of said top cap portion and said outer perimeter surfacer defining a first radio signal path and a separate ground signal path, wherein each of said first signal and ground paths are formed about different regions of said top cap portion and separately wind over said outer perimeter surface to extend to spaced apart lower portions of said cylindrical body outer perimeter surface; wherein said passage is configured to receive a portion of a retractable antenna therein; and a matching circuit including an inductor and capacitor mounted to said top cap portion of said cylindrical body and electrically connected to said first signal and ground path conductive portions of said cylindrical body.

27. An antenna base component according to claim 26, wherein said outer surface includes a threaded portion with an undercut thereon, said threaded portion including a conductive portion for electrically engaging with a ground insert in a radiotelephone housing, wherein said undercut prevents the signal path from shorting to the ground insert when assembled to the radiotelephone.

28. An antenna base component according to claim 26, wherein said cylindrical body includes an upper cap portion overlying a portion of said upper surface configured to matably engage with said antenna when said antenna is retracted, and wherein said upper cap portion together with said upper surface is configured to provide a matching circuit thereon.

29. An antenna base component according to claim 26, wherein said cylindrical body includes a primary body which is formed as a unitary body.

30. A method of forming a carrier circuit defining a signal and separate ground path for a switchable matching system in a radiotelephone retractable antenna base assembly, comprising the steps of:

molding a partial base component of a first layer of a first material;

forming a second layer of a second material over selected areas of said first layer;

positioning said second layer to maintain exposed surfaces of predetermined portions of said base component first layer; and coating exposed surfaces of said first layer with a conductive coating thereby forming three-dimensional conductive signal and ground circuits on said base component.

31. A method according to claim 30, wherein said second layer is formed of a non-catalyzed material and said first layer is formed of a catalyzed material.

32. A method according to claim 30, wherein said first layer is formed of a material receptive to metallic coatings and said second material is non-receptive to metallic coatings.

33. A method according to claim 30, further comp rising the steps of:

assembling discrete circuit components on said base component to electrically communicate with said signal path so as to define a matching circuit which is engaged with the signal path when an antenna is extended from a radiotelephone.

34. A method according to claim 30, further comprising:

exposing a selected surface to photoimaging to form a portion of said circuit carrier.

35. An antenna assembly, comprising:

a circuit carrier antenna base unit comprising a signal and ground path conductive surface pattern having predetermined conductive and non-conductive regions formed thereon, said base unit comprising an outer surface, opposing top and bottom ends, and a conductive longitudinal passage extending therethrough, wherein said signal and ground path surface pattern extends over a portion of said outer surface and said longitudinal passage conductive portion to define separate signal and ground paths; said top end including an inductor and capacitor thereon; and a retractable antenna having opposing first and second ends and defining a central axis through the center thereof, said first and second ends including respective first and second conducting portions thereon, said antenna slidably extendable through said conductive longitudinal passage along said central axis between a first extended position and a second retracted position; wherein when said antenna is in said extended position, said first conductive portion is electrically connected with said circuit carrier antenna base unit, wherein said circuit carrier base unit is configured and sized to directly contact said retractable antenna such that contact therewith activates the signal path defined by the conductive surface pattern on said circuit carrier antenna base unit which includes said inductor and capacitor when said antenna is extended and excludes said inductor and capacitor when said antenna is retracted.

* * * * *